US012780596B2

(12) United States Patent
Morgan et al.

(10) Patent No.: US 12,780,596 B2
(45) Date of Patent: Nov. 3, 2026

(54) TENSIONING ADAPTER FOR WEAVING MACHINES AND METHODS THEREOF

(71) Applicants: Esten Morgan, Roseville, CA (US); Shawna Morgan, Roseville, CA (US)

(72) Inventors: Esten Morgan, Roseville, CA (US); Shawna Morgan, Roseville, CA (US)

( * ) Notice: Subject to any disclaimer, the term of this patent is extended or adjusted under 35 U.S.C. 154(b) by 53 days.

(21) Appl. No.: 18/809,326

(22) Filed: Aug. 20, 2024

(65) Prior Publication Data

US 2026/0015200 A1 Jan. 15, 2026

Related U.S. Application Data

(60) Provisional application No. 63/669,977, filed on Jul. 11, 2024.

(51) Int. Cl.

| | |
|---|---|
| ***B65H 59/04*** | (2006.01) |
| ***D04B 15/44*** | (2006.01) |
| ***D04B 15/48*** | (2006.01) |

(52) U.S. Cl.

CPC ..... *B65H 59/04* (2013.01); *D04B 15/44* (2013.01); *D04B 15/48* (2013.01)

(58) Field of Classification Search

None

See application file for complete search history.

(56) References Cited

U.S. PATENT DOCUMENTS

| | | | | |
|---|---|---|---|---|
| 2,192,625 A * | 3/1940 | Thurston | ..... | D04B 9/46 66/146 |
| 3,575,360 A * | 4/1971 | Lawson | ..... | B65H 59/24 66/146 |
| 3,735,608 A | 5/1973 | Billi | | |
| 3,789,631 A * | 2/1974 | Deniega | ..... | D04B 15/38 200/61.18 |

(Continued)

FOREIGN PATENT DOCUMENTS

| | | |
|---|---|---|
| CN | 105442173 B | 9/2017 |
| CN | 107829205 B | 7/2023 |

(Continued)

OTHER PUBLICATIONS

English Abstract for Foreign Patent CN105442173B—retrieved on Aug. 19, 2024, online at https://patents.google.com/patent/CN105442173B/en?oq=CN105442173B.

(Continued)

*Primary Examiner* — Grace Huang

(74) *Attorney, Agent, or Firm* — Sierra IP Law, PC; William K. Nelson

(57) ABSTRACT

A tensioning adapter operable to mount to yarn guides within circular knitting machines is described. The adapter features a robust, angular main body with integrated guide channels and a plurality of tabs for precise alignment. These geometric features ensure secure locking into place and effective yarn guidance. The adapter is designed to receive and manage the yarn being fed to the knitting machine, maintaining consistent tension and alignment. The flange is (Continued)

designed to receive a mechanical tensioning device, while the carriage, featuring smooth curved edges to minimize friction, is directly in contact with the yarn guide. This configuration ensures the yarn is properly tensioned and aligned, improving the overall performance and quality of the knitting process.

18 Claims, 17 Drawing Sheets

(56) References Cited

U.S. PATENT DOCUMENTS

| | | | | | |
|---|---|---|---|---|---|
| 3,800,564 | A | | 4/1974 | Carswell | |
| 3,870,242 | A | | 3/1975 | Schussel | |
| 3,922,887 | A | * | 12/1975 | Mishcon | D04B 15/48 66/132 T |
| 3,955,769 | A | * | 5/1976 | Kajiura | D04B 15/48 242/365.5 |
| 3,975,927 | A | * | 8/1976 | Mickeler | D04B 15/58 66/134 |
| 4,752,044 | A | * | 6/1988 | Memminger | D04B 15/50 66/146 |
| 5,343,983 | A | * | 9/1994 | Horvath | D04B 15/44 188/65.1 |
| 6,089,048 | A | | 7/2000 | Lonati et al. | |
| 6,101,849 | A | * | 8/2000 | Pernick | D04B 15/58 66/125 R |
| 6,439,488 | B1 | * | 8/2002 | Hunter | D04B 15/44 242/153 |
| 7,032,414 | B2 | | 4/2006 | Lonati et al. | |
| 7,806,358 | B2 | | 10/2010 | Hoover | |
| 11,828,009 | B2 | * | 11/2023 | Huffa | B65H 59/387 |

FOREIGN PATENT DOCUMENTS

| | | | | | |
|---|---|---|---|---|---|
| CS | 255135 | B1 | | 2/1988 | |
| EP | 0381908 | A1 | * | 8/1990 | D04B 15/44 |
| EP | 0882827 | B1 | | 6/2003 | |
| EP | 3401428 | B1 | | 6/2020 | |
| EP | 4339343 | A2 | | 3/2024 | |
| FR | 2159806 | A5 | * | 6/1973 | D04B 15/38 |
| FR | 2168644 | A6 | * | 8/1973 | D04B 15/38 |
| KR | 19980056773 | U | | 10/1998 | |
| KR | 100204376 | B1 | | 6/1999 | |
| KR | 200155127 | Y1 | | 8/1999 | |
| KR | 200157719 | Y1 | | 10/1999 | |
| KR | 20040038474 | A | * | 5/2004 | |
| KR | 200363851 | Y1 | | 10/2004 | |
| KR | 200414797 | Y1 | * | 4/2006 | D04B 1/22 |
| KR | 20090004639 | U | * | 5/2009 | D04B 15/44 |

OTHER PUBLICATIONS

English Abstract for Foreign Patent CN107829205B—retrieved on Aug. 19, 2024, online at https://patents.google.com/patent/CN107829205B/en?oq=CN107829205B.

English Abstract for Foreign Patent CS255135B1—retrieved on Aug. 19, 2024, online at https://patents.google.com/patent/CS255135B1/en?oq=CS255135B1.

English Abstract for Foreign Patent KR100204376B1—retrieved on Aug. 19, 2024, online at https://patents.google.com/patent/KR100204376B1/en?oq=KR100204376B1.

English Abstract for Foreign Patent KR200155127Y1—retrieved on Aug. 19, 2024, online at https://patents.google.com/patent/KR200155127Y1/en?oq=KR200155127Y1.

English Abstract for Foreign Patent KR200157719Y1—retrieved on Jul. 1, 2024, online at https://patents.google.com/patent/KR200157719Y1/en?oq=KR200157719Y1.

English Abstract for Foreign Patent KR200363851Y1—retrieved on Aug. 19, 2024, online at https://patents.google.com/patent/KR200363851Y1/en?oq=KR200363851Y1.

English Abstract for Foreign Patent KR200414797Y1—retrieved on Jul. 1, 2024, online at https://patents.google.com/patent/KR200414797Y1/en?oq=KR200414797Y1.

English Abstract for Foreign Patent KR 19980056773—retrieved on Aug. 1, 2024, online at https://patents.google.com/patent/KR19980056773U/en?oq=KR19980056773U.

YouTube—How to use the Savlabot Tension Fork v2—retrieved on Aug. 21, 2024, online at https://www.youtube.com/watch?v=1L3_aXFNBAA.

* cited by examiner

TENSIONING ADAPTER FOR WEAVING MACHINES AND METHODS THEREOF

FIELD OF THE INVENTION

The present invention relates generally to a tensioning adapter operably secured to a yarn guide of a circular knitting machine. More particularly, the present invention provides an adapter operable to mount on a yarn guide of a circular knitting machine and receive a mechanical tensioning device operable to tension yarn fed into the same machine.

BACKGROUND OF THE INVENTION

Knitting machines require tensioning devices to produce high-quality fabrics. In particular, circular knitting machines and particular, hand-cranked knitting machines use a specific yarn guide that makes it difficult to apply tension to yarn. These hand cranked machines are favored by hobbyists due to their ease of use and quality of knitting. Machines such as these use a yarn guide to direct yarn towards the needles necessary to form stitches. Yarn guides may require tensioning in the form of an adapter. These adapters apply tension to the yarn to maintain stitch formation and improve the quality of the fabric being produced.

Weighted tension forks, spring-loaded tension forks, dial tensioners, and the like are unstable and it is difficult to apply tension with these devices when inserting yarn within the knitting machine. Additionally, these devices can only apply a fixed amount of tension. Therefore, there exists a need for a secure yarn guide device and adjustably apply tension to the yarn.

SUMMARY OF THE INVENTION

The present invention provides a tensioning adapter that may be operable to securely attach to a yarn guide of a circular knitting machine. Tensioning adapters of the present invention may be designed to receive a mechanical tensioning device. The mechanical tensioning device may be operable to apply tension to the yarn feeding towards the circular knitting machine.

In some embodiments, there may be a first tensioning adapter that may be operably incorporated into a yarn guide of a circular knitting machine. The first tensioning adapter may include a base plate, carriage, and a flange vertically extending from the base plate. The flange may include a polygonal aperture operable to receive a mechanical tensioning device. The carriage may have a hollow back surface and two tabs operable to fit into the yarn guide of a circular knitting machine.

The base plate of the tensioning adapter may have an upper surface, bottom surface, a front edge, and a back edge. The front edge of the tensioning adapter may transition towards a hook with a partially circular geometry. The hook may descend towards a central opening, which opens towards a slot operable to receive yarn.

The flange of the first tensioning adapter may be positioned near a front edge of the base plate. In such embodiments, the flange may laterally extend from the top surface of the base plate towards a curved surface which transitions towards a rounded portion near the apex of the flange. At the center of the flange is a polygonal aperture with a receptacle operable to secure a mechanical tensioning device. The receptacle may travel from inside the polygonal aperture towards a back surface of the flange.

There may be a carriage positioned at the back edge of the base plate. The carriage may have a tapered front surface with two parallel side walls extending from the front surface. The carriage may also have a top surface with a rectangular opening and a slot in between the top surface and the tapered front surface. There may be two parallel tapered edges traveling on opposite sides of the slot. In such embodiments, the carriage may have a hollow back surface, and a bottom surface with a rectangular opening vertically aligned to the rectangular opening on the top surface.

The mechanical tensioning device of the present invention may include a plurality of components operable to apply tension to yarn fed through a circular knitting machine. These components may include a helical spring, a spring retainer, a plurality of washers, a spring plate, a threaded rod, a bolt, an adjustment knob, and the like.

In some embodiments, the mechanical tensioning device may be mounted to the first tensioning device using a flange. The mounting bracket may be first inserted within the polygonal aperture of the flange, which then secures a threaded rod. The threaded rod also secures a spring plate and spring retainer. The spring retainer may secure the helical spring, and an adjustment device may be mounted to the retainer.

In most embodiments, the adjustment device may be operable to adjust the tension of the yarn being fed through the circular knitting machine. The tension may be adjusted between three modes including light, medium, and heavy. In other embodiments, the tension may be adjusted differently than described.

In some embodiments, the first tensioning adapter may be operable to mount to a yarn guide of circular knitting machines and receive a mechanical tensioning device operable to apply tension to yarn fed within the circular knitting machine. Examples of such machines may include hand-cranked circular knitting machines, flat panel knitting machines, hand-held knitting machines, and the like.

Materials used to construct the mechanical tensioning device may vary depending on strength, durability, and performance. For example, some materials may include stainless steel, carbon steel, brass, aluminum, ceramic, polymeric materials, and combinations thereof.

In another embodiment, there may be a second tensioning adapter operable to securely mount to yarn guides of circular knitting machines. The second tensioning adapter may include a base plate, a flange, a hook, and a plurality of tabs extending horizontally outwards from a right edge of the flange.

The base plate of the second tensioning adapter may include a top surface, a bottom surface. There may be at least three tabs laterally extending horizontally outwards from the top surface of the base plate. In such embodiments, the third tab may transition from a smooth surface at a lower elevation to a raised surface.

Each tab may extend outwards at a different distance. For example, the first tab may extend outwards at the shortest distance, the second tab may extend outwards at a medium distance, and the third tab may extend outwards at the largest distance. The medium distance may be a distance in between the shortest and largest distance. In such embodiments, each of the tabs may extend horizontally outwards at a distance ranging between 5 mm to 20 mm.

In such embodiments, each of the tabs may be positioned equidistant from each other, such that the second tab is positioned in between the first and third tabs. Tabs on the base plate may be operable to accommodate to the geometry of the yarn guide, thereby securing the tensioning adapter to the circular knitting machine without additional user intervention. Tensioning adapter may further include a fourth tab below a base plate operable to lock a device to a yarn guide.

The flange of the second tensioning adapter may be positioned near a front edge of the base plate. In such embodiments, the flange may laterally extend from the top surface of the base plate towards a curved surface which transitions towards a rounded portion near the apex of the flange. At the center of the flange is a polygonal aperture with a receptacle operable to secure a mechanical tensioning device. The receptacle may travel from inside the polygonal aperture towards a back surface of the flange.

The mechanical tensioning device may be secured to the flange by inserting a plug to the back surface of the flange. Therefore, the mechanical tensioning device is securely locked in place when tension is applied to yarn guided through a circular knitting machine.

At a left edge of the flange is a hook with a partially circular geometry. The hook may extend from the left edge of the flange and curve around to form a loop. The hook may curve inwards towards the bottom surface of the base plate to reveal an opening. The opening may allow for the insertion of yarn within the second tensioning adapter.

Function

In some embodiments, the second tensioning adapter may be mounted to the yarn guide of a circular knitting machine. The yarn guide of the same machine may include a sliding mechanism operable to unlock a channel. The channel may be operable to receive a second tab of the tensioning adapter. In such embodiments, the third tab may have a raised surface operable to align with the sliding mechanism and secure the second tensioning adapter to the circular knitting machine.

In yet another embodiment, there may be a third tensioner adapter operable to mount to yarn guides of circular knitting machines. The third tensioner adapter may be a slightly modified version of the second tensioner adapter, where a fourth tab is positioned beneath the bottom surface of the base plate.

The fourth tab of the third tensioner adapter may operably extend laterally outwards towards the edge of the second tab. Firstly, the fourth tab pivots at an angle from the bottom surface of the base plate and transitions towards a smooth surface which travels towards the distal edge of the second tab. Therefore, the distal edge of the fourth tab and the distal edge of the second tab are horizontally aligned. The angle for pivoting the fourth tab may range between 30 degrees to 90 degrees in such embodiments.

In some embodiments, the third tensioning adapter may be operably mounted to a yarn guide of a different circular knitting machine.

The first, second, and third tensioning adapters may be constructed from materials operable to improve longevity and performance. Some examples of materials used for each of the tensioning adapters may include ceramic, polyethylene terephthalate glycol, polypropylene, and steel.

Materials used to construct the mechanical tensioning device may be constructed of steel.

The circular knitting machines applicable to the present invention may utilize different types of yarn depending on the project. For example, some types of yarn operably guided through the tensioning adapter of the present invention may include medium weight yarn, double knitting weight, acrylic yarn, cotton yarn.

Each type of yarn used within circular knitting machines may require a different needle size. Needles may be placed around the circumference of the circular knitting machine, and may be sized between the range of 4.5 to 5.5 mm in some exemplary embodiments.

The types of circular knitting machines applicable to the present invention may vary depending on the application. For example, the first tensioning adapter may be applicable towards a different circular knitting machine than the second and third tensioning adapters. The reason for this is the yarn guide on each circular knitting machine may differ, thereby accommodating different geometries for each tensioning adapter.

Therefore, some examples of circular knitting machines with yarn guides may include hand-cranked circular knitting machines, electric circular knitting machines, adjustable needle circular knitting machines, professional grade circular knitting machines, and the like.

In some embodiments, the first, second, and third tensioning adapters may be operable to receive a mechanical tensioning device. The mechanical tensioning device may be operably connected to the flange of each of the adapters, through a nut and mounting bracket. The mounting bracket may include a protruding tab or clip operable to guide the yarn. At the distal end of the tensioning device is a adjustment device operable to adjust the tension of the yarn flowing through the tensioning adapters.

In some exemplary embodiments, the mechanical tensioning device may be unassembled by loosening the adjustment device. Therefore, components on the mechanical tensioning device may be disassembled by first loosening and removing the adjustment device. Then, spring and tension discs may operably slide off the main shaft. When removing components from the tensioning device, any excess or stray fibers may be removed to improve the performance of the tensioning adapter.

Therefore, it is an object of the present invention to provide a tensioning adapter operable to accommodate to yarn guides from a plurality of circular knitting machines.

It is an aspect of the present invention provide a hands-free tensioning adapter secured to a yarn guide of a circular knitting machine, the adapter may include a base plate having a top surface, a front edge, a right edge, and a rear edge; a carriage secured to a rear edge of the base plate having a front surface, a top surface having two tabs, two tapered surfaces extending from the front surface, two parallel side walls extending horizontally from the front surface, and a hollow back surface; a flange vertically extending from the top surface of the base plate, the flange having a front surface, a back surface, and a polygonal aperture; a hook extending from the front edge of the base plate, the hook having an opening; a mechanical tensioning device having a shaft, a mounting bracket, at least two discs, a spring, and an adjustment device; The polygonal aperture of the flange is operable to receive the mounting bracket of the mechanical tensioning device, where the mechanical tensioning device is operable to receive yarn traveling between the two discs and the slot on the carriage is operably aligned with an opening within the yarn guide and the two tabs on the carriage are positioned around the yarn guide to lock the tensioning adapter to the same yarn guide.

It is another aspect to provide a method of mounting a tensioning adapter to a circular knitting machine that may include opening a sliding mechanism on a yarn guide of the circular knitting machine, where the yarn guide includes a channel; providing a tensioning adapter having a first tab, a second tab, and a third tab, a flange, a hook, and a base plate; inserting a second tab of the tensioning adapter within the channel of the yarn guide; closing the sliding mechanism of the yarn guide. The third tab of the tensioning adapter includes a raised surface operable to align with the sliding mechanism to lock the tensioning adapter within the yarn guide. The second tab may be positioned in the center of the first and third tabs, and each of the first tab, second tab, and third tabs may be positioned equidistant from each other. The mechanical tensioning device may be inserted within a polygonal aperture on the flange of the tensioning adapter.

It is another aspect of the present invention to provide a device operable to tension yarn within a yarn guide of a circular knitting machine, the device may include a tensioning adapter having a first tab, a second tab, a third tab, a flange with aperture, a hook, and a base plate; a mechanical tensioning device operably inserted into said aperture, said mechanical tensioning device having a mounting bracket, a first disc, a second disc, a spring with spring retainer, and an adjustment device. The tensioning adapter is mountable to a yarn guide of the circular knitting machine and the mechanical tensioning device is operable to receive yarn between the first and second discs and apply tension to the yarn using the adjustment device and the spring. The adapter may be secured to the yarn guide by sliding the second tab within a channel of the yarn guide, and the third tab may include a raised surface operable to align with a sliding mechanism of the yarn guide.

Further aspects and embodiments will be apparent to those having skill in the art from the description and disclosure provided herein.

It is another object of the present invention to provide a tensioning adapter operable to securely mount to a yarn guide of a circular knitting machine.

It is another object of the present invention to provide a tensioning adapter operable to receive a mechanical tensioning device operable to apply tension to yarn being fed through a circular knitting machine.

It is an object of the present invention to provide a tensioning adapter operable to guide yarn through a circular knitting machine.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

DETAILED DESCRIPTION

Figure 1:
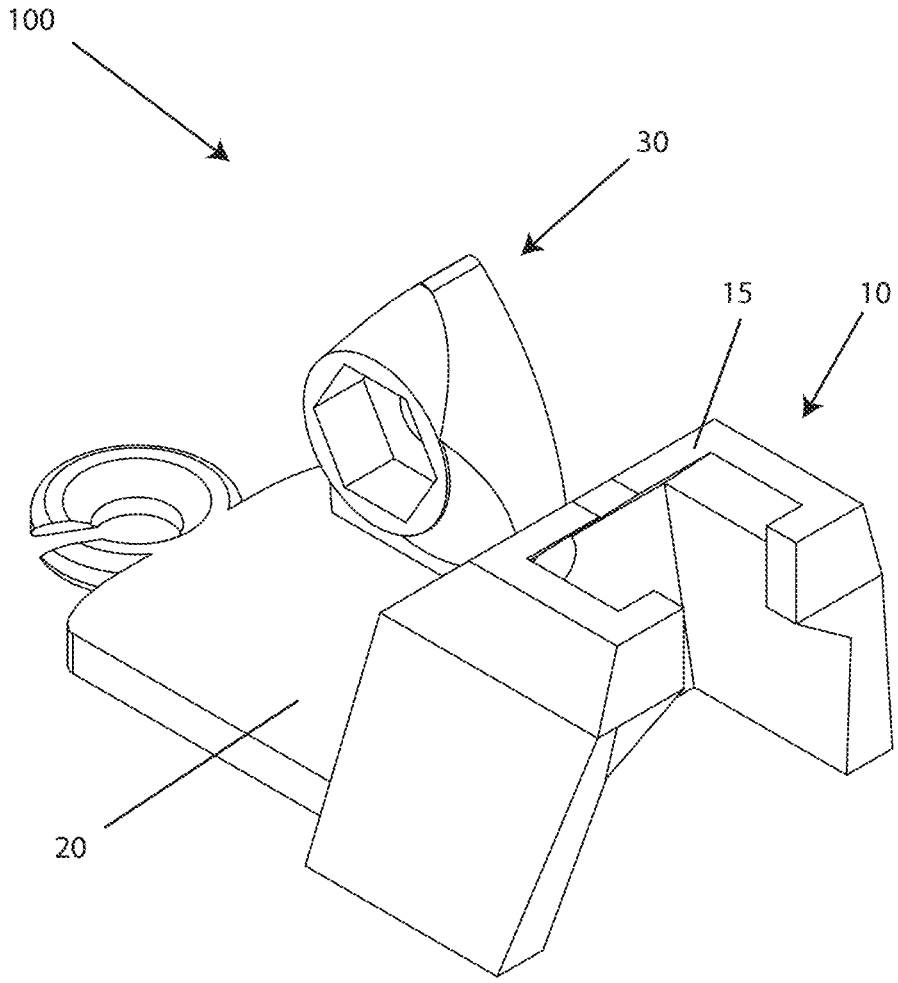
FIG. 1 provides a perspective view of a first tensioning adapter, according to an embodiment of the present invention.
Figure 2A:
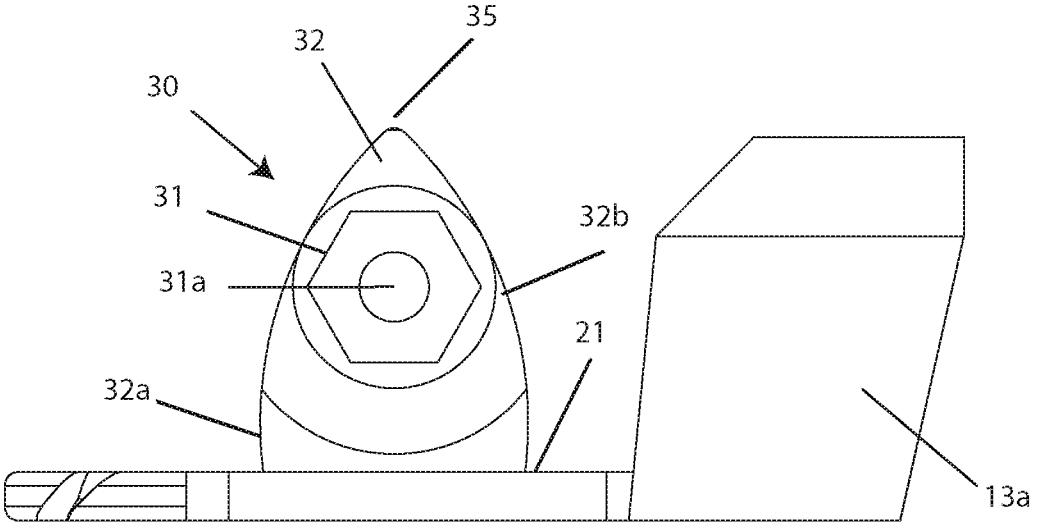
FIG. 2*a* provides a first side view of a first tensioning adapter, according to an embodiment of the present invention.
Figure 2B:
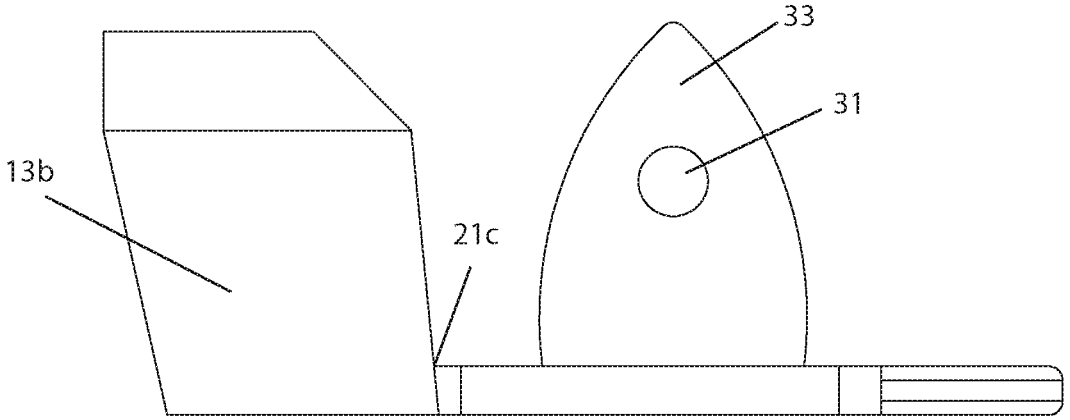
FIG. 2*b* provides a second side view of a first tensioning adapter, according to an embodiment of the present invention.
Figure 3:
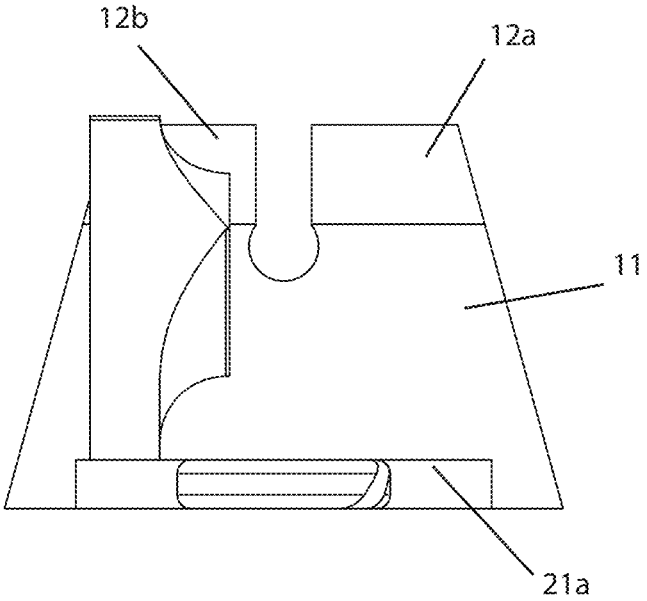
FIG. 3 provides a front view of a first tensioning adapter, according to an embodiment of the present invention.
Figure 4:
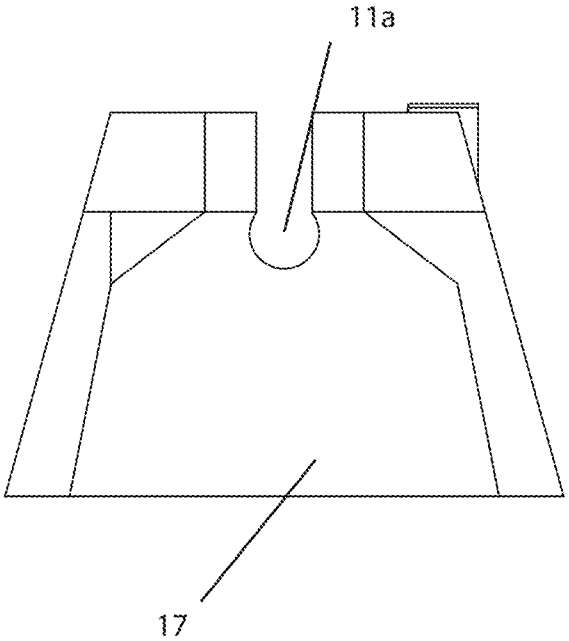
FIG. 4 provides a rear view of a first tensioning adapter, according to an embodiment of the present invention.
Figure 5:
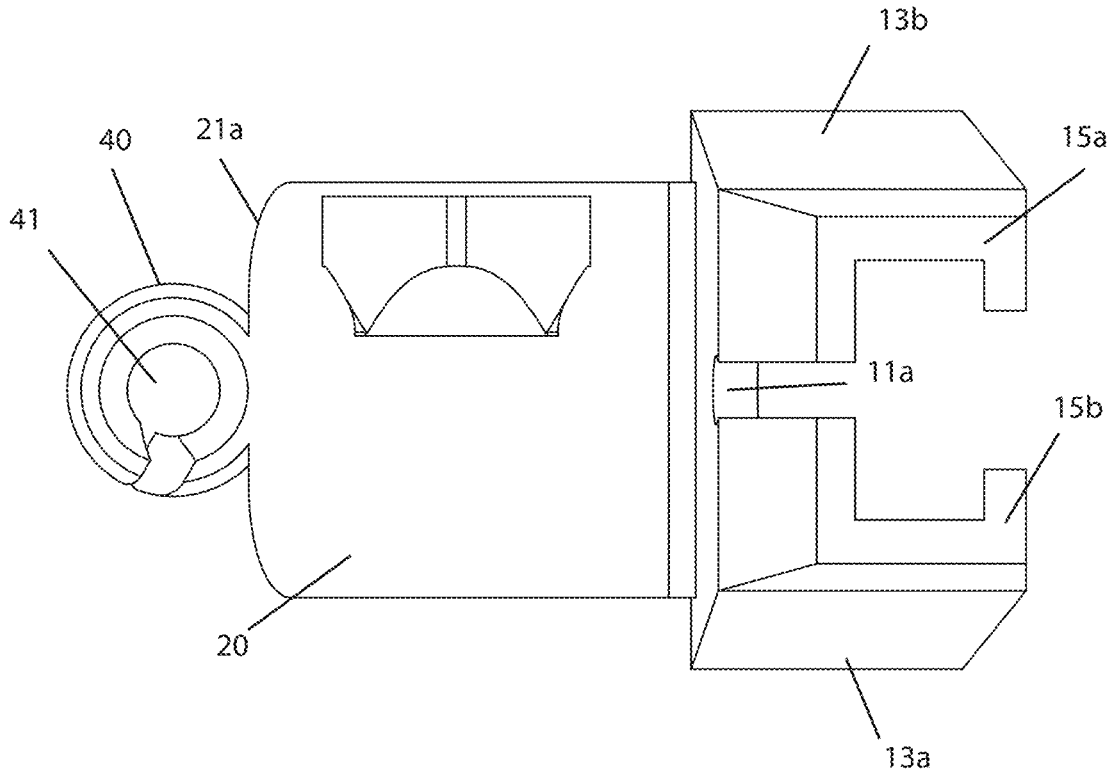
FIG. 5 provides a top view of a first tensioning adapter, according to an embodiment of the present invention.
Figure 6:
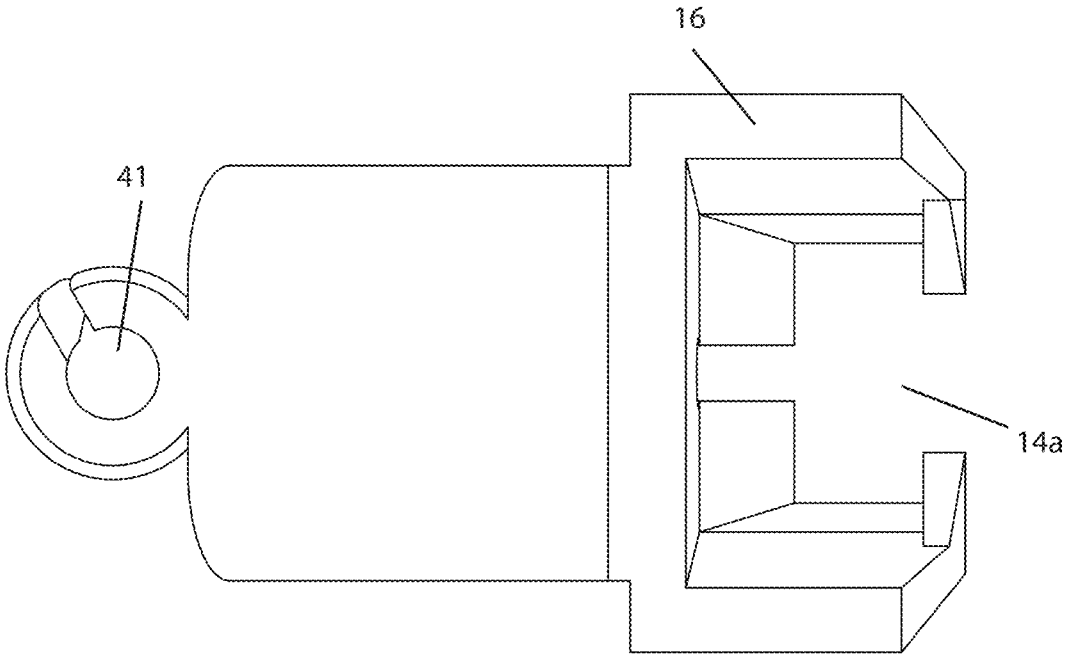
FIG. 6 provides a bottom view of a first tensioning adapter, according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

Referring to the drawings, wherein like reference characters designate like or corresponding parts throughout the several views, and referring particularly to FIGS. 1-27, it is seen that the present invention includes embodiments describing a tensioning adapter operable to receive a mechanical tensioning device and securely attach to yarn guides within circular knitting machines.

The present invention, as shown in FIGS. 1-6, concerns a first tensioning adapter 100 with a carriage 10, a base plate 20, and a flange 30. The carriage 10 may be secured to the back edge 21*c* of the base plate 20. A flange 30 with shaft receiver (e.g., polygonal aperture 31 with opening 31*a*) may extend vertically from the top surface 21 of the base plate 20. There may also be a hook 40 with a central opening 41 attached to a front edge 21*a* of the base plate 20.

In some embodiments, carriage 10 may have a front surface 11 with a slot 11*a*, two tapered surfaces 12*a* and 12*b*, two symmetric side walls 13*a* and 13*b*, a top surface 15 having two tabs 15*a* and 15*b*, and a bottom surface 16. The two tapered surfaces 12*a* and 12*b* may travel from front surface 11 towards rectangular opening 14*a*, and the slot 11*a* may be centered in between both tapered surfaces 12*a*-12*b*. The top surface 15 may define rectangular opening 14*a* traveling between top surface 15 and bottom surface 16, such that the opening 14*a* is tapered towards the bottom surface to accommodate for the geometry of the yarn guide 62. Tabs 15*a*, and 15*b* may be operable to lock adapter 100 to the yarn guide 62, preventing the adapter 100 from moving in place. In particular, tabs 15*a* and 15*b* may reveal a hollow back surface 17 operable to secure the adapter 100 to the yarn guide 62 on a circular knitting machine 60.

The geometry of the carriage 10 allows the device 100 to be securely adapted to the yarn guide 62, while providing an unobstructed path for yarn or thread through the slot 62*a* in guide 62. The adapter 100 provides an autonomous guide and tensioner for the yarn that allows the user to set up the adapter 100 and allow the machine to operate without user intervention.

The flange 30 may have a front surface 32 and a back surface 33 with a polygonal receptacle 31 positioned on the front surface 32. The flange 30 may extend vertically from a top surface 21 of the base plate towards a curved surface 32*a*. Curved surface 32*a* may transition towards a rounded surface 32*b* towards apex 35. At the center of the front surface 32 is a polygonal aperture 31 operable to receive a mechanical tensioning device 50. Polygonal aperture 31 may travel between a front surface 32 and a rear surface 33 of the flange 30.

Figure 8:
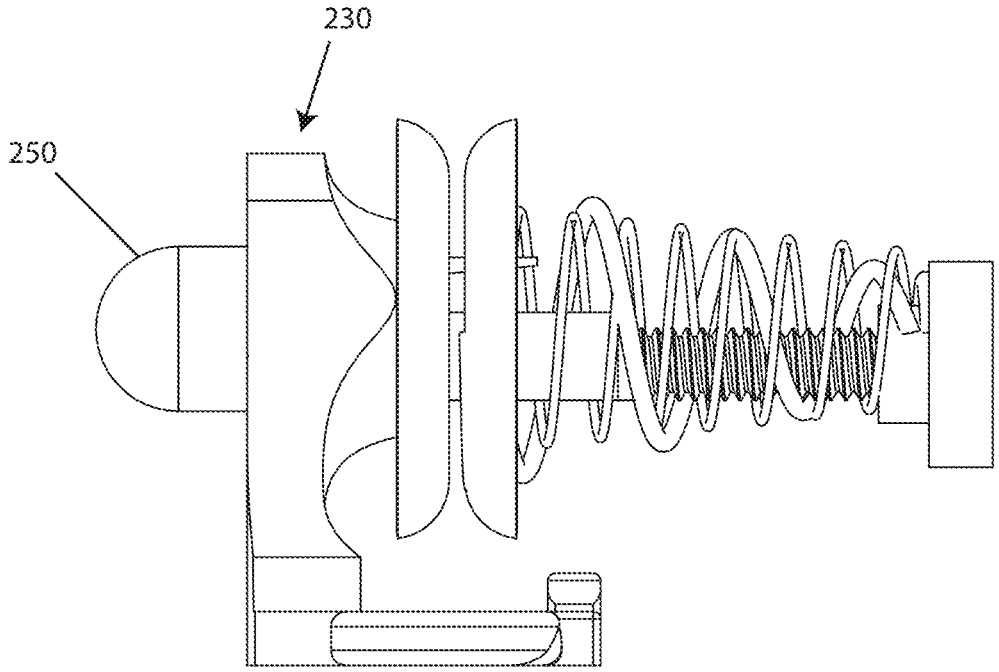
FIG. 8 provides a side view of a second tensioning adapter, according to an embodiment of the present invention.
Figure 9:
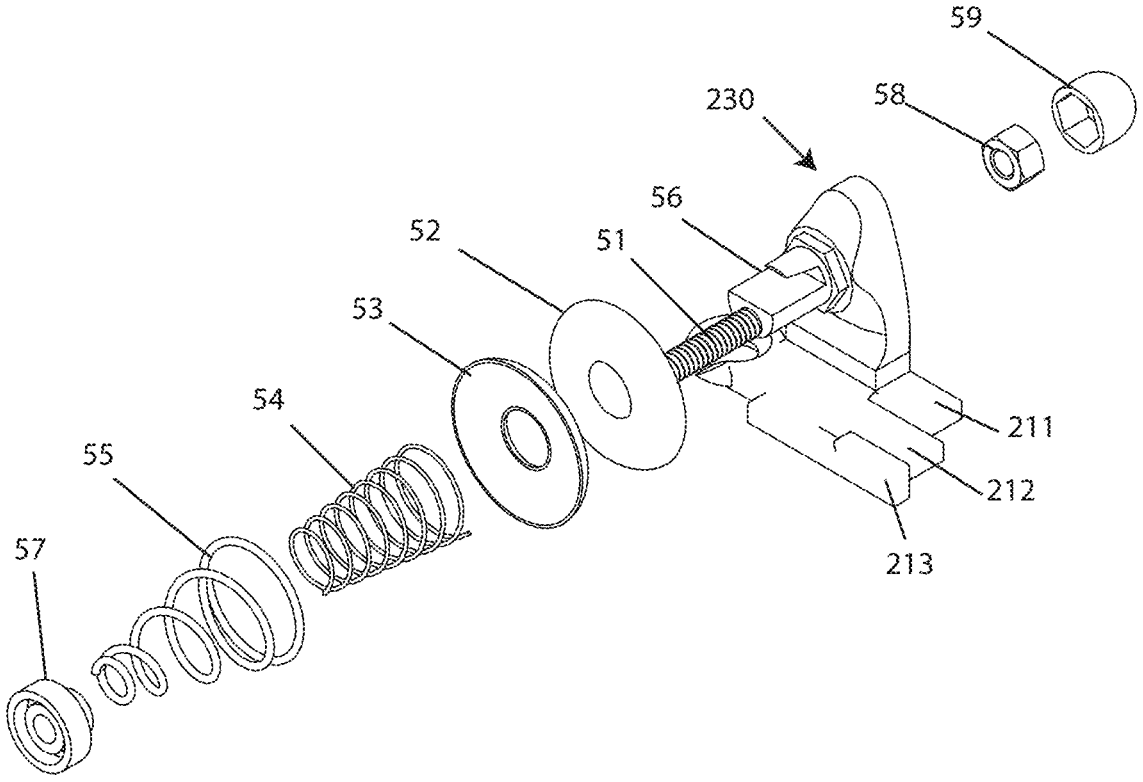
FIG. 9 provides an exploded view of a mechanical tensioning device and tensioning adapter, according to an embodiment of the present invention.
Figure 10:
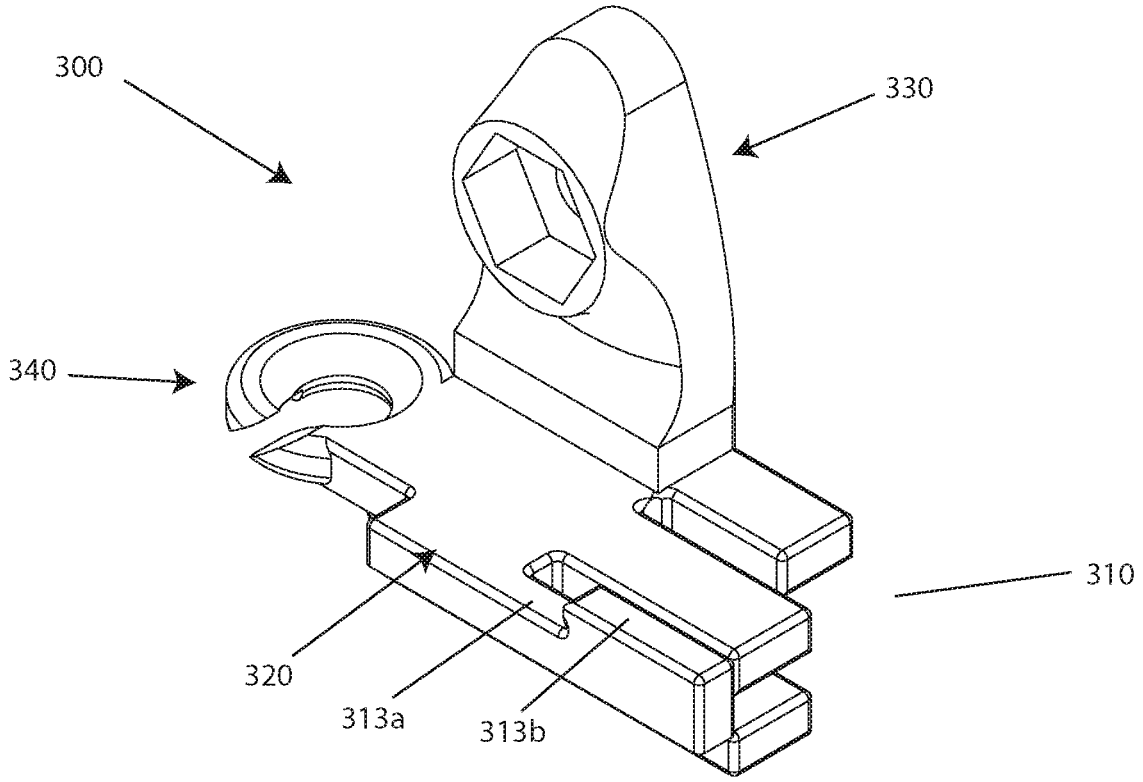
FIG. 10 provides a perspective view of a third tensioning adapter, according to an embodiment of the present invention.
Figure 11:
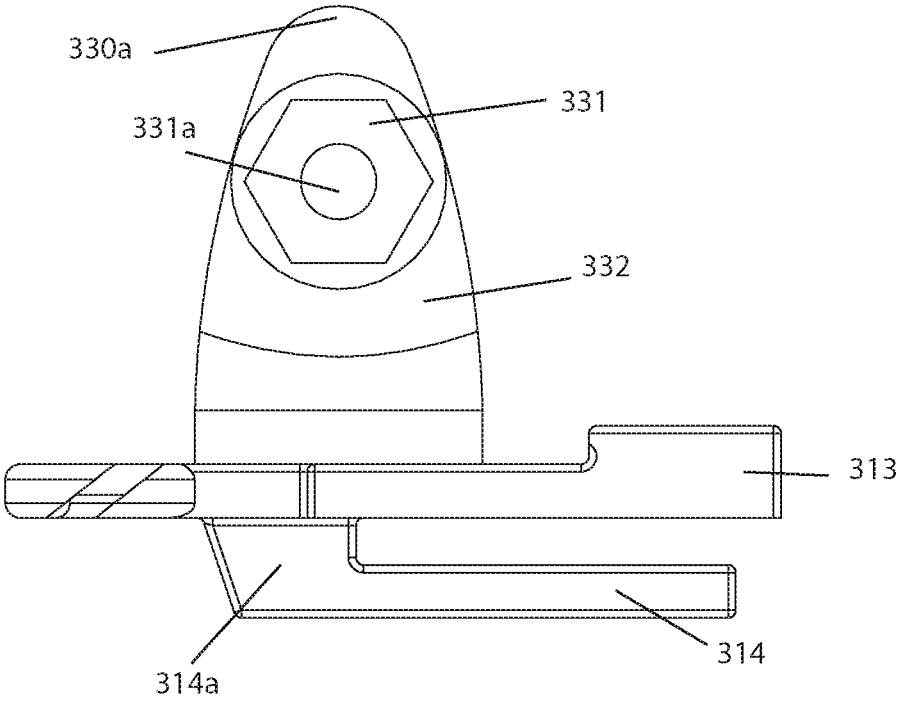
FIG. 11 provides a front view of a third tensioning adapter, according to an embodiment of the present invention.
Figure 12:
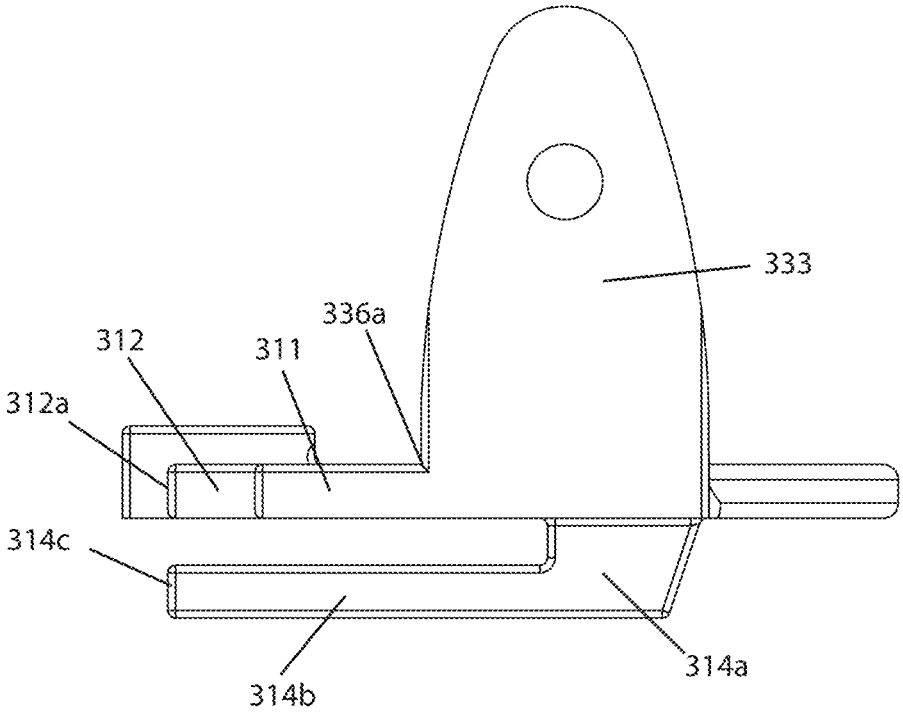
FIG. 12 provides a rear view of a third tensioning adapter, according to an embodiment of the present invention.
Figure 13:
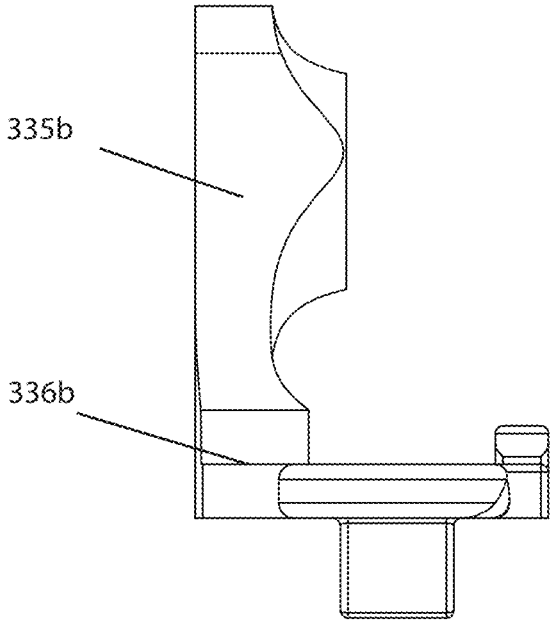
FIG. 13 provides a first side view of a third tensioning adapter, according to an embodiment of the present invention.
Figure 14:
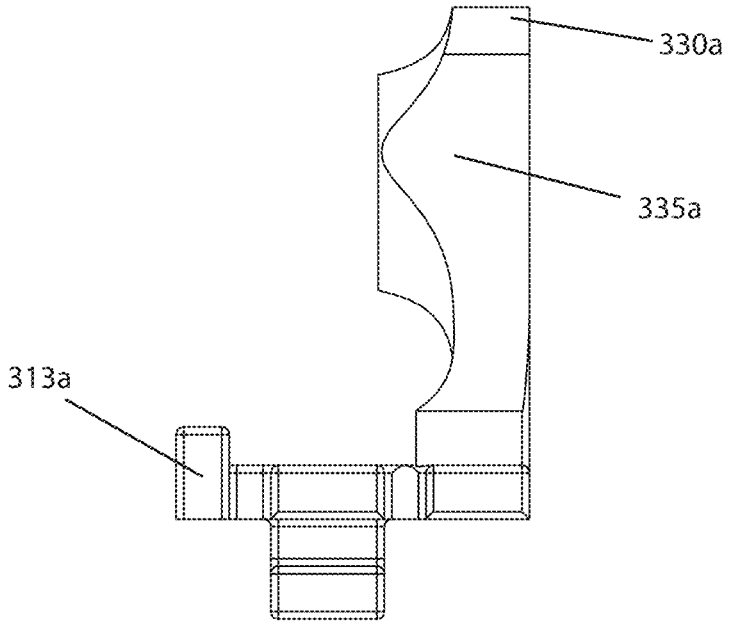
FIG. 14 provides a second side view of a third tensioning adapter, according to an embodiment of the present invention.
Figure 15:
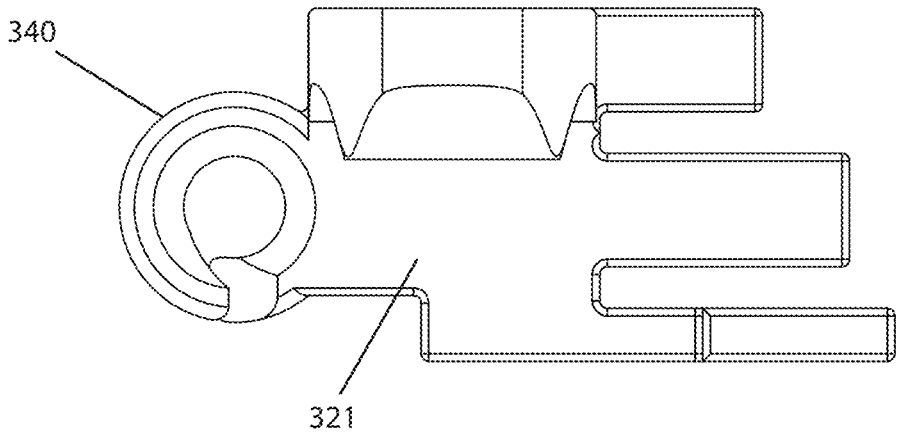
FIG. 15 provides a top view of a third tensioning adapter, according to an embodiment of the present invention.
Figure 16:
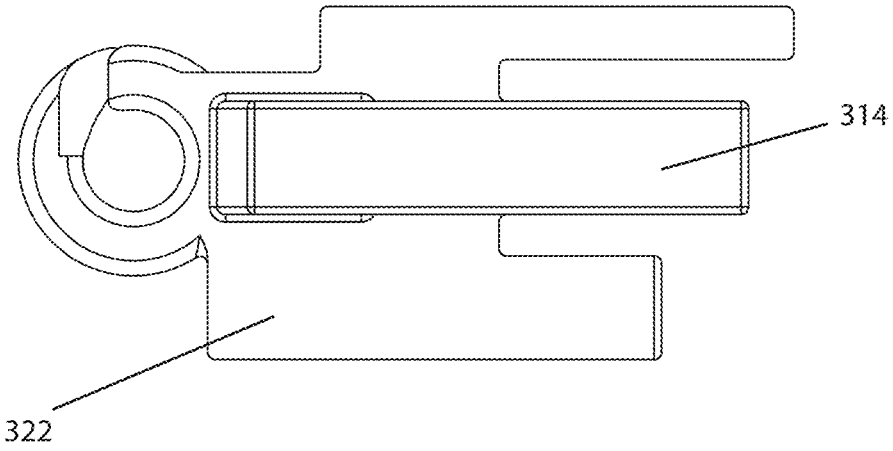
FIG. 16 provides a bottom view of a third tensioning adapter, according to an embodiment of the present invention.
Figure 17:
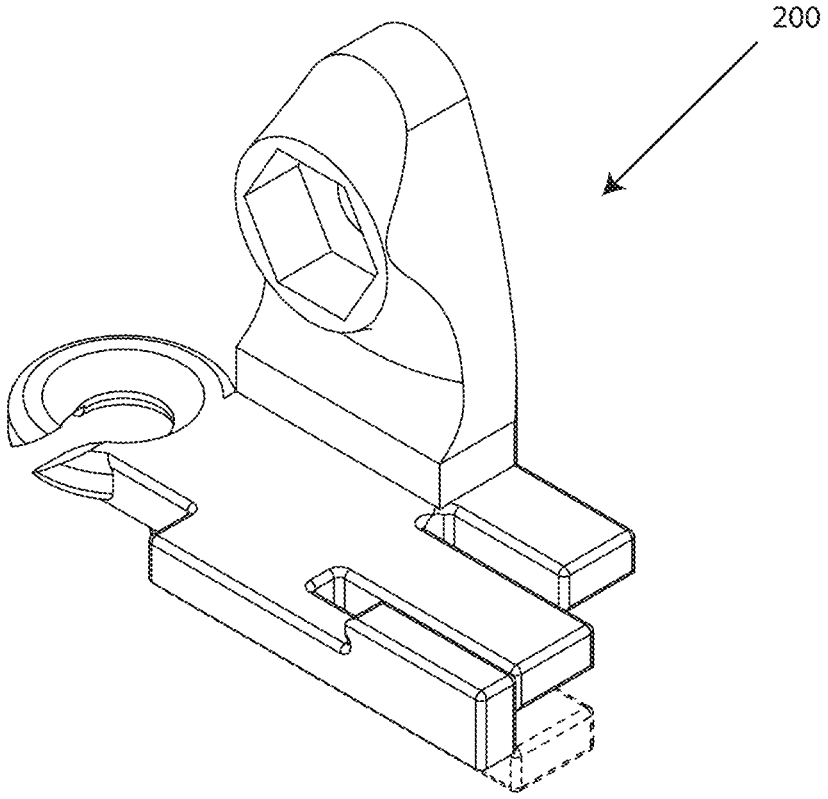
FIG. 17 provides a perspective view of a second tensioning adapter, according to an embodiment of the present invention.
Figure 18:
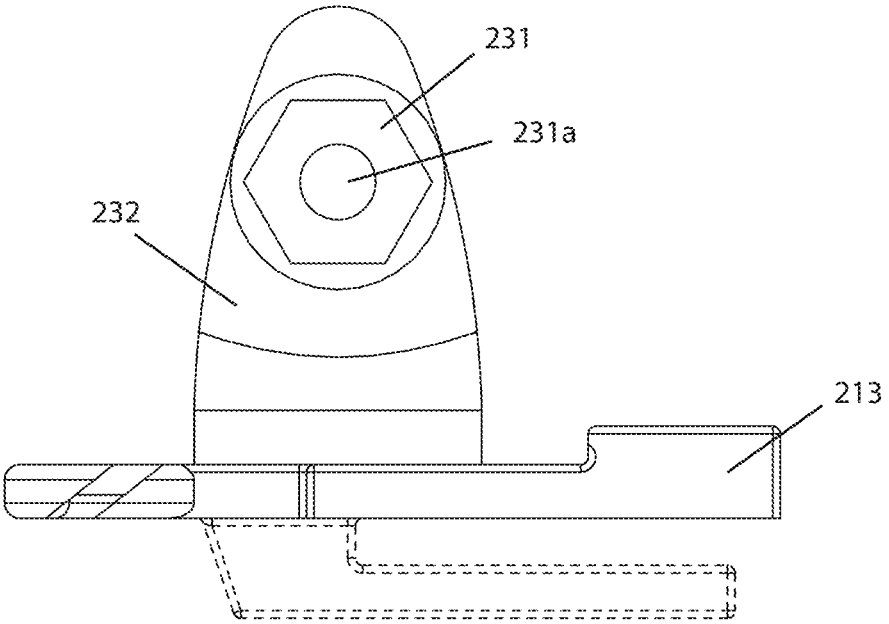
FIG. 18 provides a front view of a second tensioning adapter, according to an embodiment of the present invention.
Figure 19:
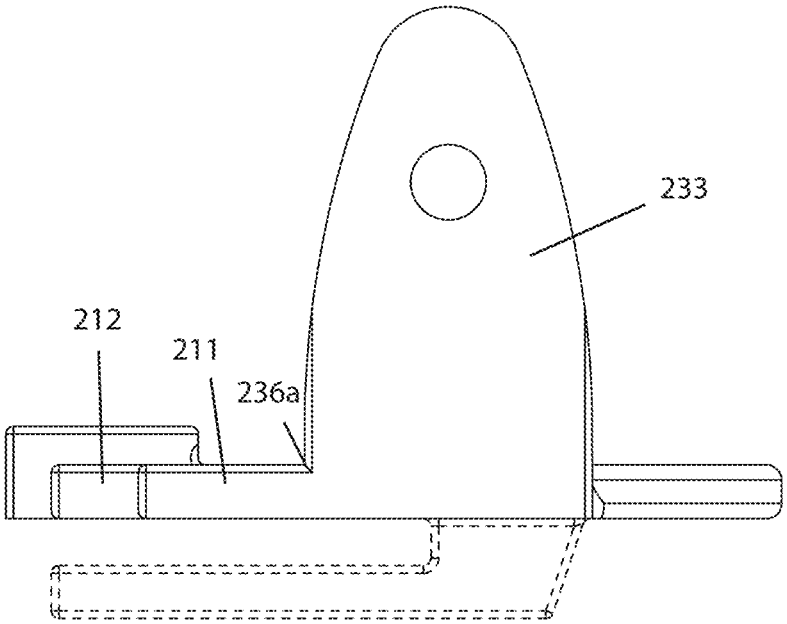
FIG. 19 provides a rear view of a third tensioning adapter, according to an embodiment of the present invention.
Figure 20:
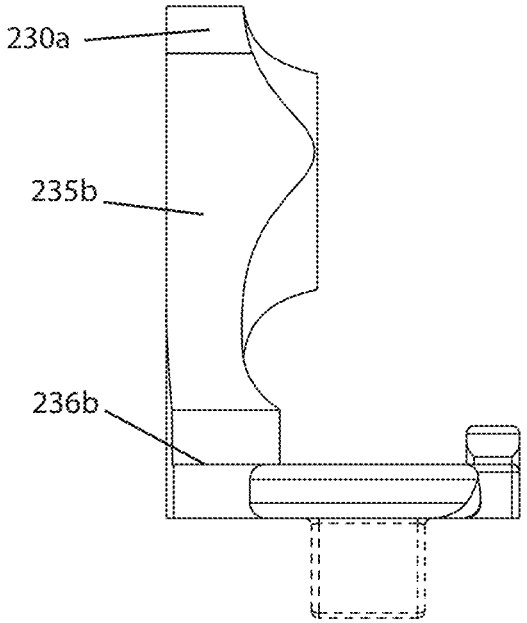
FIG. 20 provides a first side view of a second tensioning adapter, according to an embodiment of the present invention.
Figure 21:
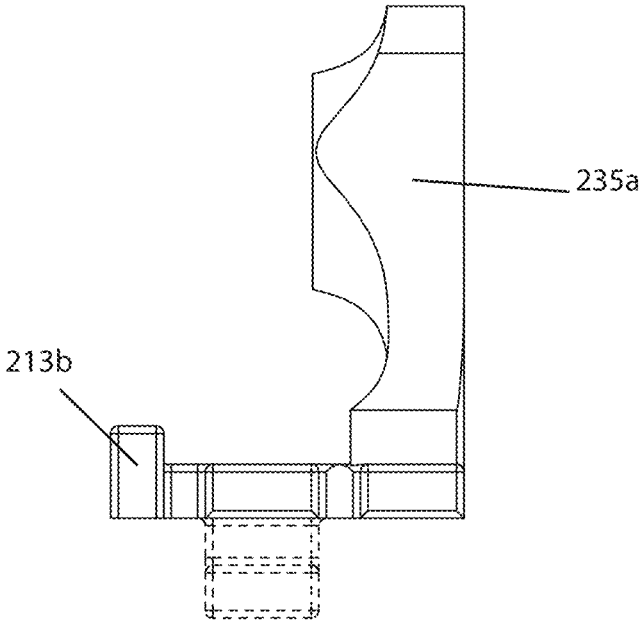
FIG. 21 provides a second side view of a second tensioning adapter, according to an embodiment of the present invention.
Figure 22:
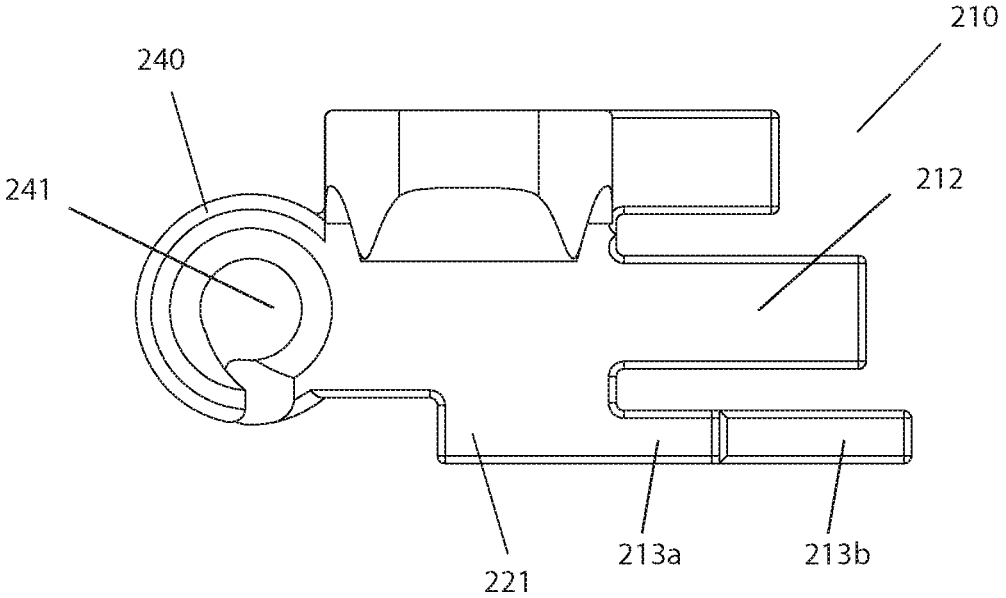
FIG. 22 provides a top view of a second tensioning adapter, according to an embodiment of the present invention.
Figure 23:
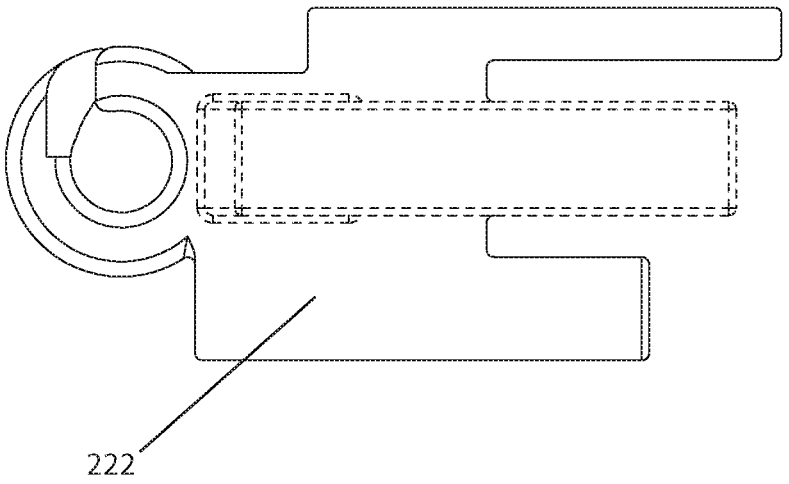
FIG. 23 provides a bottom view of a second tensioning adapter, according to an embodiment of the present invention.
Figure 24A:
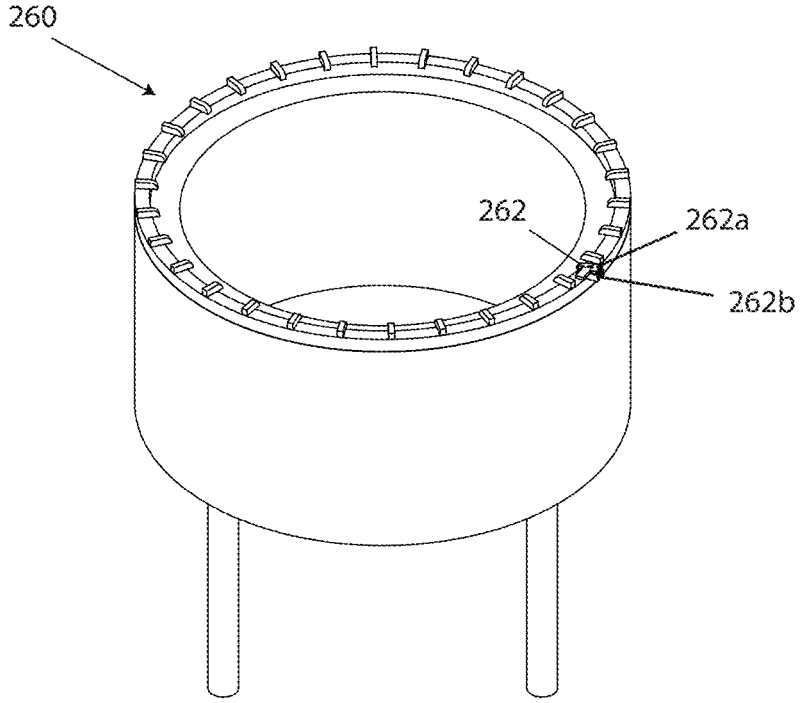
FIG. 24*a* provides a first environmental view of a circular knitting machine, according to an embodiment of the present invention.
Figure 24B:
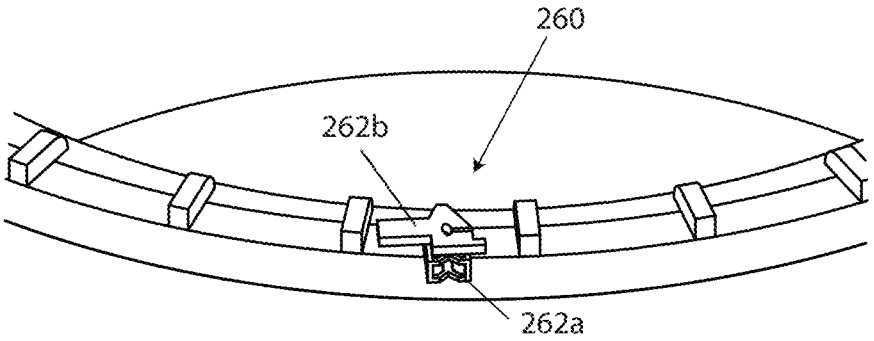
FIG. 24*b* provides a second environmental view of a circular knitting machine, according to an embodiment of the present invention.
Figure 25A:
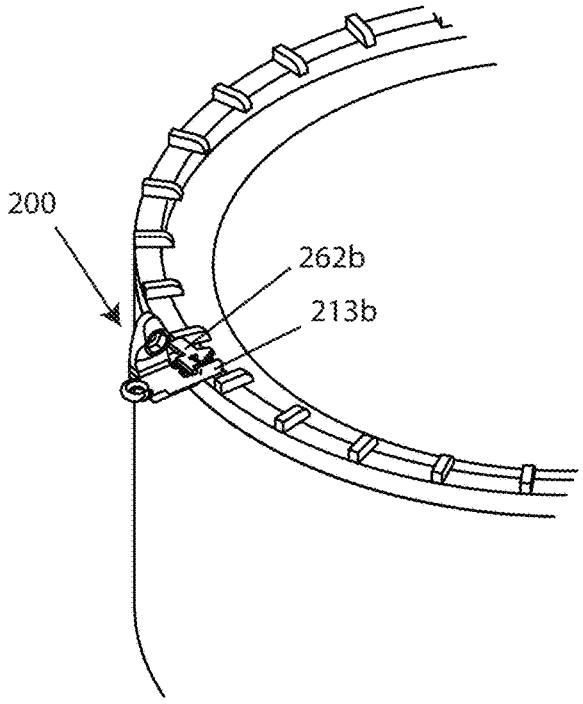
FIG. 25*a* provides a first environmental view of a second tensioning adapter according to an embodiment of the present invention.
Figure 25B:
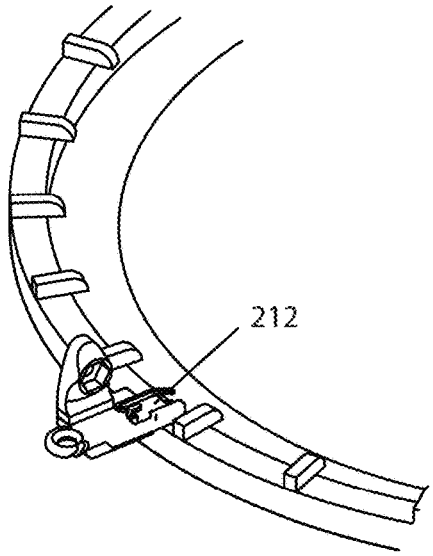
FIG. 25*b* provides a second environmental view of a second tensioning adapter, according to an embodiment of the present invention.
Figure 25C:
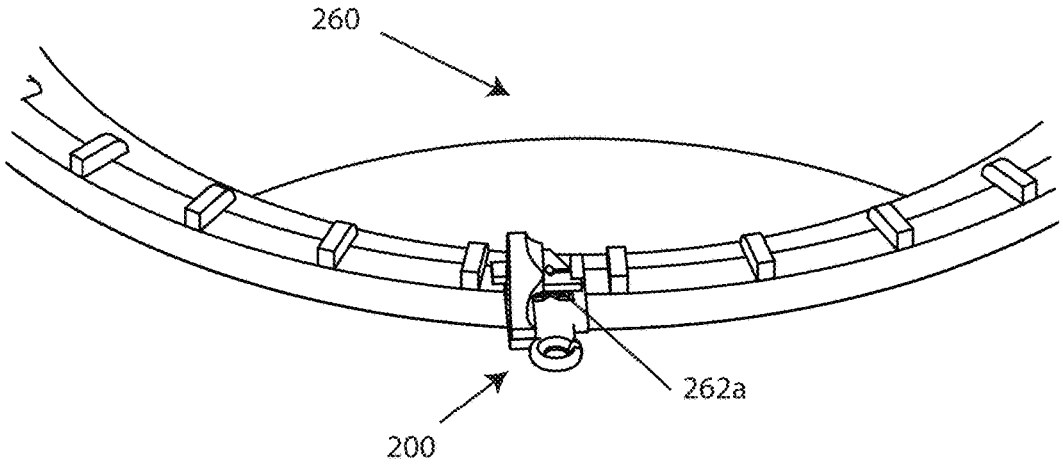
FIG. 25*c* provides a third environmental view of a second tensioning adapter, according to an embodiment of the present invention.
Figure 26A:
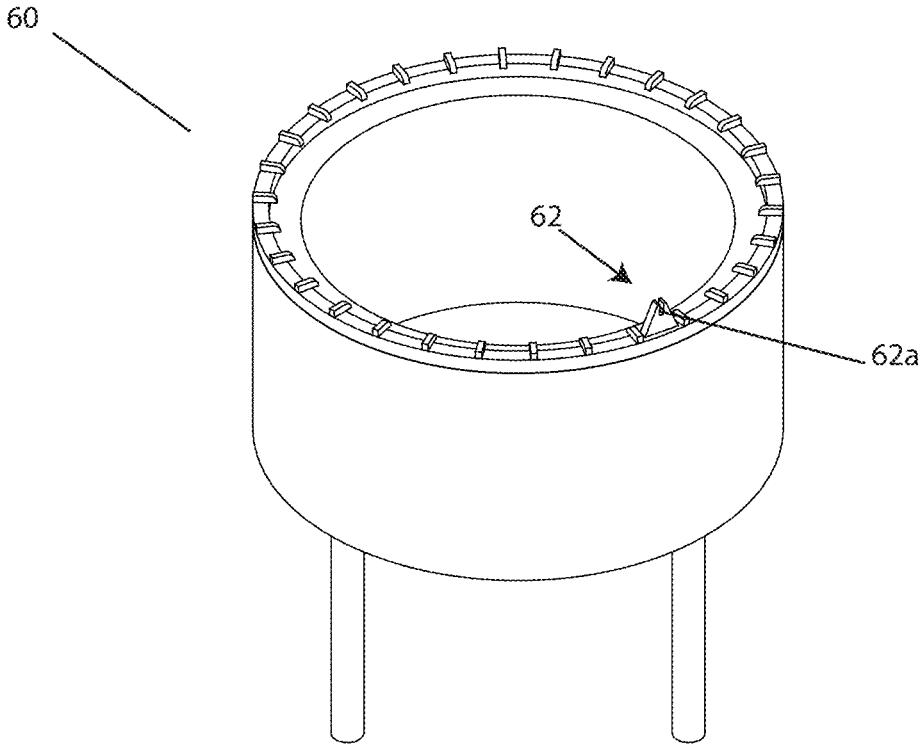
FIG. 26*a* provides a third environmental view of a circular knitting machine, according to an embodiment of the present invention.
Figure 26B:
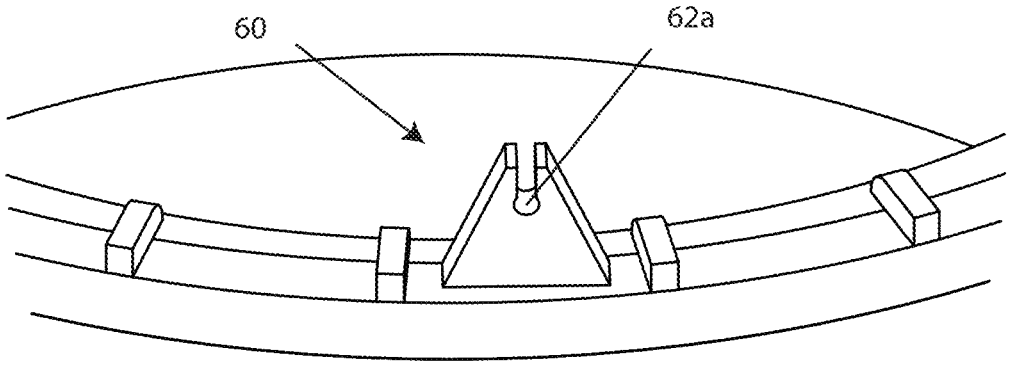
FIG. 26*b* provides a fourth environmental view of a circular knitting machine, according to an embodiment of the present invention.
Figure 27A:
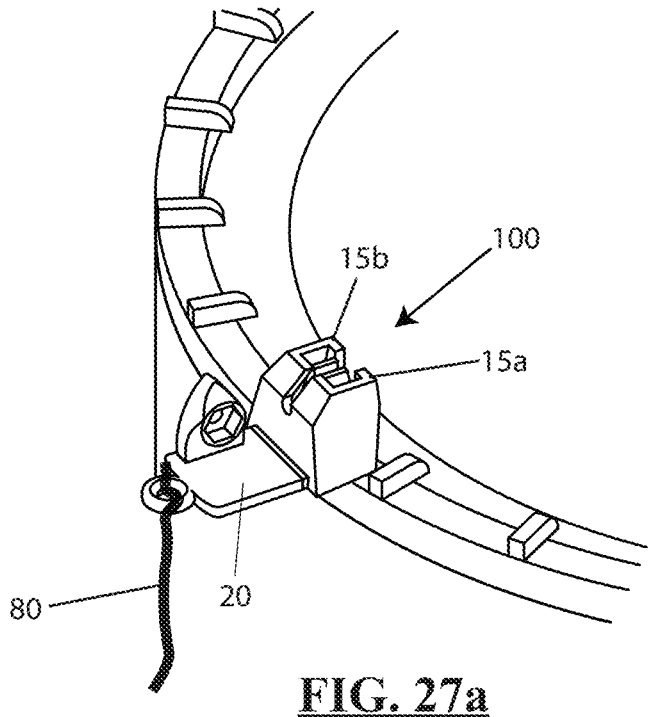
FIG. 27*a* provides a first environmental view of a first tensioning adapter, according to an embodiment of the present invention.
Figure 27B:
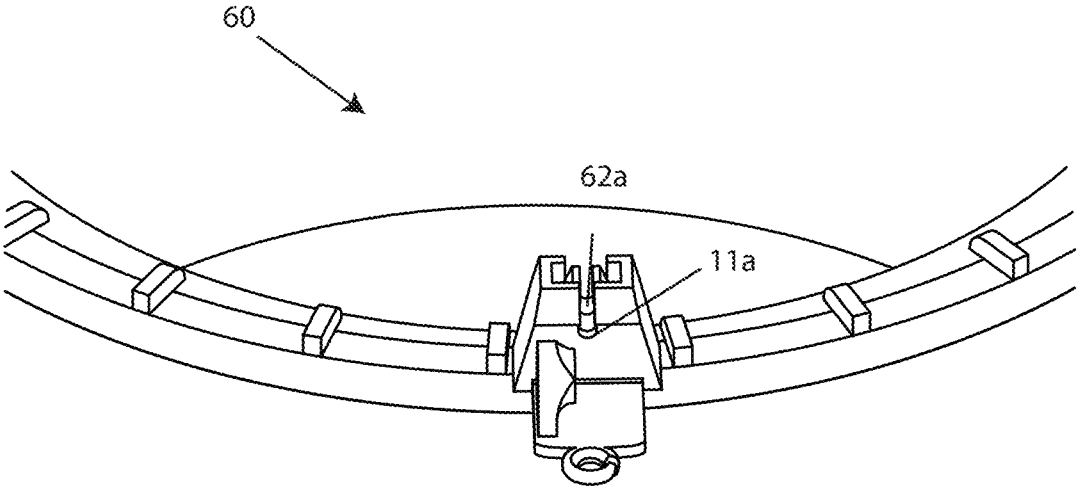
FIG. 27*b* provides a second environmental view of a first tensioning adapter, according to an embodiment of the present invention.

Turning to the mechanical tensioning device 50 as shown in FIGS. 8 and 9, the mechanical tensioning device 50 may include a shaft 51, first disc 52, second disc 53, spring 54, spring retainer 55, mounting bracket 56, adjustment device 57, nut 58, and plug 59. In such embodiments, the polygonal aperture 31 may be operable to receive the mounting bracket 56. The mounting bracket 56 may be operable to receive shaft 51, which is operable to receive discs 52 and 53 along with spring 54. Spring 54 may be secured within spring retainer 55, and the mechanical tensioning device 50 may be tightened using adjustment device 57. The mechanical tensioning device 50 may be securely locked to flange 30 using nut 58 and plug 59, which may be inserted within aperture 31 on the back surface 33 of flange 30.

In some embodiments, the first disc 52 may be a spring disc and the second disc 53 may be a tension disc. In other embodiments, the first disc 52 may be a tension disc and the second disc may be a spring disc.

In some embodiments, as shown in FIGS. 26*a*-27*b*, the first tensioning adapter 100 may be mounted to a circular knitting machine 60. In particular, the carriage 10 of the first adapter 100 may be operably mounted to a yarn guide 62. Tabs 15*a*-15*b* and hollow back surface 17 may secure the adapter 100 to the yarn guide 62, preventing the adapter 100 from moving in place. In such embodiments, the slot 11*a* may be aligned with a channel 62*a* within the yarn guide.

Yarn 80 may be inserted within the central opening 41 of hook 40, and may be guided between discs 52 and 53 of tensioning device 50 towards channel 62*a* of the yarn guide 62.

Figure 7:
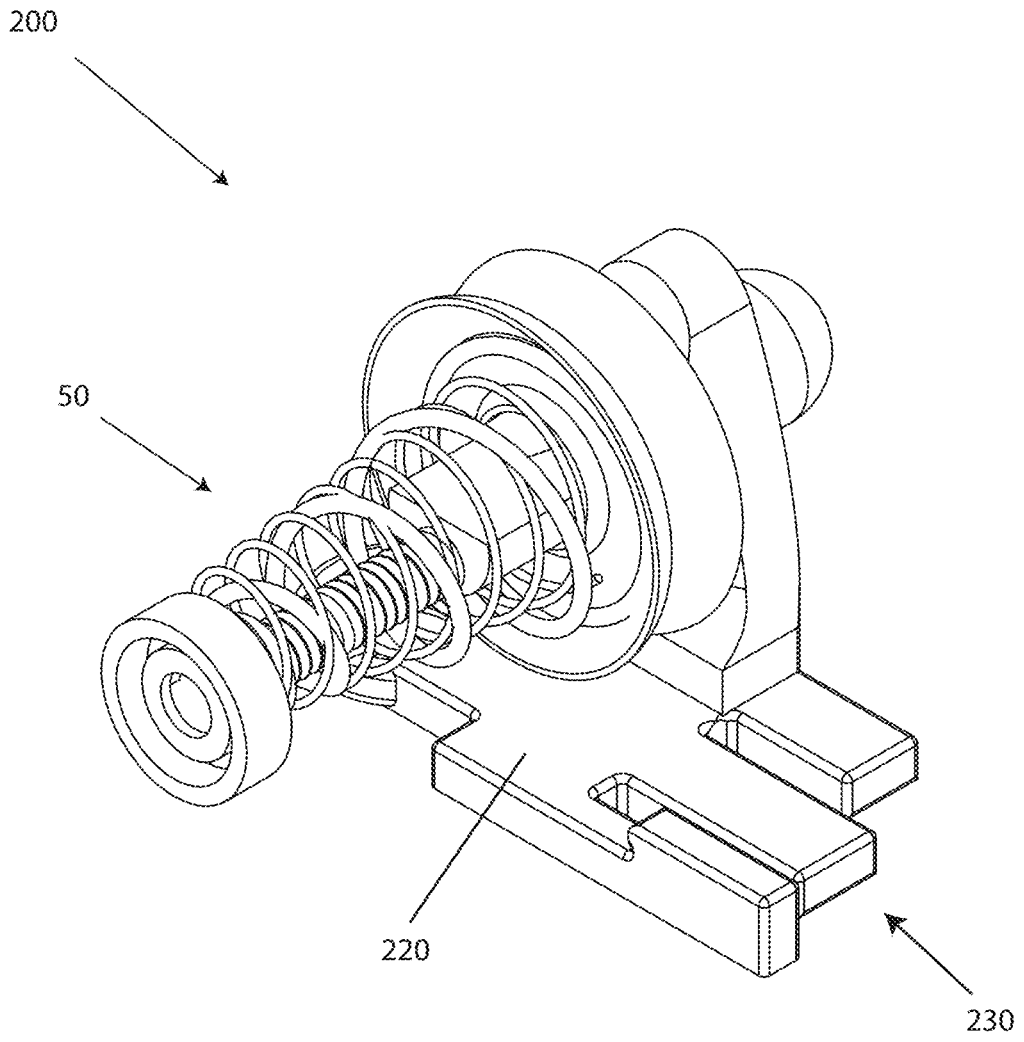
FIG. 7 provides a perspective view of a second tensioning adapter, according to an embodiment of the present invention.

In some embodiments, there may be a second tensioning adapter 200 operable to securely mount to the yarn guide 262 of a circular knitting machine 260. The second tensioning adapter may have a base plate 220, tabs 210, hook 240 and a flange 230 with aperture 231, as shown in FIGS. 17-23. The second tensioning adapter 200 may also be operable to receive a mechanical tensioning device 50 through the flange 230, as shown in FIG. 7-9. The base plate 220 may have an upper surface 221 and a bottom surface 222. In such embodiments, the flange 230 may extend vertically from an upper surface 221 of the base plate 220. The flange 230 may have an inclined front surface 232 and a back surface 233, where the front surface 232 has a polygonal aperture 231 with an opening 231*a*. Extending upwards from the base plate 220 is an inclined front surface 232, which transitions to form a rounded edge at an apex 230*a* of the flange 230. The flange 230 may also contain two parallel side surfaces 235*a*-235*b* each converging towards the apex 330*a* and descending towards edges 236*a*-236*b* respectively. In such embodiments, there may be a plurality of tabs 210 laterally extending horizontally from the upper surface 221 of the base plate 220. More specifically, the plurality of tabs 210 may extend laterally outwards from right edge 236*a* of the flange 230. In most embodiments, there may be three tabs 211-213, each tab extending laterally outwards from an upper surface 221 of the base plate 220.

The first tab 211 may be positioned near the right edge 236*a* of the flange 230. The third tab 213 may be positioned near the second tab 212 and may transition between a smooth surface 213*a* towards a raised surface 213*b*. Tabs 211-213 may be positioned equidistant from each other. For example, the distance between tabs 211 and 212 may be the same as the distance between tab 212 and tab 213. In most embodiments, the second tab 212 may be horizontally aligned with the central opening 241 of hook 240.

Therefore, the orientation of tabs 211-213 may allow users to mount the tensioning adapter 200 on the yarn guide 262 without significant manual intervention.

In some embodiments, the second tensioning adapter 200 may include a hook 240 extending from the upper surface 221 of the base plate. The hook 240 may be designed with a partially circular geometry that curves around to form an opening 241.

In some embodiments, as shown in FIGS. 24*a*-25*c*, the second tensioning adapter 200 may be mounted to the yarn guide 262 of a circular knitting machine 260. The yarn guide 262 may have a sliding mechanism 262*b* operable to receive yarn 80 and a channel 262*a* operable to receive a second tab 212 of the tensioning adapter 200.

Sliding mechanism 262*b* of the guide 262 may be unlocked to receive yarn 80 and reveal a channel 262*a*. Channel 262*a* may be operable to receive the second tab 212 of the tensioning adapter 200. Once the second tab 212 is inserted within the guide 262, the sliding mechanism 262*b* may be closed, and the raised surface 213*b* of tab 213 may be used to lock the tensioning adapter 200 in place. Therefore, the tensioning adapter 200 is securely mounted to the guide 262 without significant user intervention.

In some embodiments, a third tensioning adapter 300 may be operable to securely mount to the yarn guide 262 of a circular knitting machine 260. The third tensioning adapter 300 may have a base plate 320 with an upper surface 321 and a lower surface 322, a flange 330, tabs 310, and a hook 340. As shown in FIGS. 10-14, the flange 330 may extend vertically from an upper surface 321 of the base plate 320. The flange 330 may have an inclined front surface 332 and a back surface 333, where the front surface 332 has a polygonal aperture 331 with an aperture 331*a*. Extending upwards from the base plate 320 is an inclined front surface 332, which transitions to form a rounded edge at an apex 330*a* of the flange 330. The flange 330 may also contain two parallel side surfaces 335*a*-335*b*, each converging towards the apex 330*a* and descending towards edges 336*a*-336*b* respectively. Edges 336*a*-336*b* may be described as being first edge 336*a* and second edge 336*b*.

In some embodiments, there may be a plurality of tabs 310 each extending from upper surface 321 of the base plate 320. There may be at least three tabs 311-313 operably aligned with the upper surface 321, where tab 312 is positioned equidistant from both tab 311 and tab 313. Tab 313 may also transition from a smooth surface 313*a* towards a raised surface 313*b*. In some exemplary embodiments, there may be a fourth tab 314 laterally extending from the bottom surface 322 of the base plate. The fourth tab 314 may transition between a pivot arm/right-angle mount 314*a* towards a smooth surface 314*b*. In such embodiments, the fourth tab may also have a distal edge 314*c* operably aligned with a distal edge 312*a* of tab 312.

In some embodiments, there may be a plurality of tabs 310 laterally extending from the upper surface 321 of the base plate. More specifically, the plurality of tabs 310 may extend laterally outwards from the first edge 336*a* of the flange 330. In most embodiments, there may be three tabs 311-313, each tab extending laterally outwards from an upper surface 321 of the base plate 320. There may also be a fourth tab 314 with a right-angle mount 314*a* that laterally extends outwards from the bottom surface 322 of the base plate 320.

In some embodiments, the third tensioning adapter 300 may include a hook 340 extending from the upper surface 321 of the base plate. The hook 340 may be designed with a partially circular geometry that curves around to form a opening 341. Hook 340 may be positioned near a second edge 336*b* of said flange.

In some embodiments, the third tensioning adapter 300 may be operably mounted to the yarn guide 262 using similar methods as disclosed by the second tensioning adapter 200. For example, the third tensioning adapter 300 may be secured to the yarn guide 262 by sliding second tab 312 within channel 262*a*, and securing third tab 313 along sliding mechanism 262*b*.

In some embodiments, first tensioner adapter 100, second tensioner adapter 200, and third tensioner adapter 300 may each be operable to accommodate a plurality of yarn guides 62 or 262 placed on a plurality of circular knitting machines 60 or 260. In some exemplary embodiments, the second tensioner adapter 200 and the third tensioner adapter 300 may be operable to secure on a similar yarn guide 260.

Method of Use

In some embodiments, the tensioner adapter 200 may be mounted to a circular knitting machine 260. The first tensioning adapter 100 or the second tensioning adapter 200 may be attached to the yarn guide 62 or 262. For the first tensioning adapter 100, the carriage 10 may be aligned with the yarn guide 62 on the circular knitting machine 60, ensuring that the tabs 15*a* and 15*b* on the top surface 15 are positioned to securely lock the adapter 100 to the yarn guide 62. Once positioned, the first tensioning adapter 100 is secured on the yarn guide 62, engaging the hollow back surface 17 with the guide to lock the adapter 100 in place.

For the second tensioning adapter 200, the base plate 220 may be positioned such that the tabs 211 through 213 align with the corresponding slots in the yarn guide 262, with the second tab 212 aligned to fit into the channel 262*a*. The second tab 212 may be slid into the channel 262*a* of the yarn guide 262, and the sliding mechanism 262*b* may be closed to secure the tab 212, and use the raised surface 213*b* of tab 213 to lock the adapter firmly.

The mechanical tensioning device 50 may be assembled, including the shaft 51, discs 52 and 53, spring 54, spring retainer 55, and mounting bracket 56. The mounting bracket may be inserted into the polygonal aperture 31 or 231 on the flange 30 or 230 of the tensioning adapter, ensuring the shaft 51 is correctly aligned within the aperture. The mechanical tensioning device 50 may be secured by tightening it with the adjustment device 57 and the nut 58 may be tightened and plug 59 may be inserted into the back surface 33 or 233 of the flange 30 or 230.

With the device installed, the yarn 80 may be threaded by passing it through the central opening 41 or 241 of the hook 40 or 240 attached to the tensioning adapter 100 or 200. The yarn 80 may be guided between the first disc 52 and the second disc 53 of the mechanical tensioning device 50, where the spring tension applied by the discs will control the yarn tension. The yarn 80 may be properly aligned with the channel 62*a* or 262*a* of the yarn guide 62 or 262, allowing it to feed smoothly into the circular knitting machine 60 or 260.

The tension of the yarn 80 may be adjusted as needed by rotating the adjustment device 57 on the mechanical tensioning device 50, which changes the compression of the spring 54 and the pressure applied by the discs 52 and 53.

Once the tensioning device 50 is properly installed and adjusted, the circular knitting machine 60 or 260 can be activated. The yarn 80 will be fed through the yarn guide 62 or 262 and tensioning device 50, ensuring consistent tension throughout the knitting process.

It is to be understood that variations, modifications, and permutations of embodiments of the present invention, and uses thereof, may be made without departing from the scope of the invention. It is also to be understood that the present invention is not limited by the specific embodiments, descriptions, or illustrations or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed:

1. A method of mounting a tensioning adapter to a circular knitting machine, the method comprising:

a) opening a sliding mechanism on a yarn guide of said circular knitting machine, said yarn guide having a channel, b) providing the tensioning adapter having a first tab, a second tab, and a third tab, a flange, a hook, an aperture, and a base plate, wherein said first tab, second tab, and said third tab each laterally extend horizontally outwards at different distances;

c) inserting a mechanical tensioning device into said aperture;

d) inserting the second tab of said tensioning adapter within said channel of said yarn guide; and e) closing said sliding mechanism on said yarn guide.

2. The method of claim 1, wherein said third tab includes a raised surface operable to align with said sliding mechanism to lock said tensioning adapter to said yarn guide.

3. The method of claim 1, said tensioning adapter further comprising a fourth tab operable to secure said tensioning adapter to said yarn guide.

4. The method of claim 1, wherein said first tab, said second tab, and said third tab are positioned such that they are evenly spaced on said tensioning adapter.

5. The method of claim 4, wherein said second tab is positioned in the center of said first tab and said third tab.

6. The method of claim 1, wherein said aperture is a polygonal aperture defined by said flange and operable to receive said mechanical tensioning device.

7. A device operable to tension yarn within a yarn guide of a circular knitting machine, said device comprising:

a) a tensioning adapter having a first tab, a second tab, a third tab, a flange with an aperture, a hook, and a base plate, wherein said first tab, said second tab, and said third tab each laterally extend horizontally outwards from said base plate at different distances; and b) a mechanical tensioning device operably inserted into said aperture, said mechanical tensioning device having a mounting bracket, a first disc, a second disc, a spring with a spring retainer, and an adjustment device;

wherein said tensioning adapter is operable to be mounted to the yarn guide of said circular knitting machine and said mechanical tensioning device is operable to receive the yarn between said first disc and said second disc and apply tension to said yarn using said adjustment device and said spring.

8. The device of claim 7, wherein said tensioning adapter is configured to be secured to said yarn guide by sliding said second tab within a channel of said yarn guide.

9. The device of claim 8, wherein said third tab includes a raised surface configured to align to a sliding mechanism of said yarn guide.

10. The device of claim 7, wherein said tensioning adapter further comprises a fourth tab extending from below said base plate operable to secure said device to said yarn guide.

11. The device of claim 10, wherein a distal edge of said fourth tab is vertically aligned with a distal edge of said second tab.

12. The device of claim 7, wherein said tensioning adapter is constructed from polycarbonate, polyethylene terephthalate glycol, and polypropylene.

13. A device operable to tension yarn within a yarn guide of a circular knitting machine, said device comprising:

a) a tensioning adapter having a first tab, a second tab, a third tab, a flange with an aperture, and a fourth tab below a base plate;

b) a mechanical tensioning device operably inserted into said aperture, said mechanical tensioning device having a first disc and a second disc;

wherein said tensioning adapter is configured to be mounted to the yarn guide of said circular knitting machine and said fourth tab is operable to lock said device to said yarn guide, and said mechanical tensioning device is operable to apply the tension to the yarn received between said first disc and said second disc.

14. The device of claim 13, wherein said tensioning adapter is configured to be secured to said yarn guide by sliding said second tab within a channel of said yarn guide.

15. The device of claim 13, wherein said third tab includes a raised surface operably aligned to a sliding mechanism of said yarn guide.

16. The device of claim 13, wherein a distal edge of said fourth tab is vertically aligned with a distal edge of said second tab.

17. The device of claim 13, wherein said first tab, said second tab, and said third tab each laterally extend horizontally outwards at different distances.

18. The device of claim 13, wherein said tensioning adapter is constructed from polycarbonate, polyethylene terephthalate glycol, and polypropylene.

* * * * *